US006491174B1

(12) United States Patent
Day

(10) Patent No.: US 6,491,174 B1
(45) Date of Patent: Dec. 10, 2002

(54) INVERTED PEDESTAL CRANE

(75) Inventor: Howard W F Day, Madisonville, LA (US)

(73) Assignee: Friede & Goldman, Ltd., Houston, TX (US)

( * ) Notice: Subject to any disclaimer, the term of this patent is extended or adjusted under 35 U.S.C. 154(b) by 0 days.

(21) Appl. No.: 09/491,564

(22) Filed: Jan. 26, 2000

(51) Int. Cl.[7] ..... B66C 23/18

(52) U.S. Cl. ..... 212/179; 212/231; 212/238; 212/253

(58) Field of Search ..... 114/268; 212/317, 212/179, 223–253, 261, 333, 334, 335, 341, 342

(56) References Cited

U.S. PATENT DOCUMENTS

| | | | | |
|---|---|---|---|---|
| 427,260 | A | * | 5/1890 | Forter |
| 2,978,116 | A | * | 4/1961 | Wells et al. |
| 3,463,329 | A | * | 8/1969 | Gartner |
| 3,898,847 | A | | 8/1975 | Magnanini |
| 3,949,693 | A | | 4/1976 | Bauer et al. |
| 4,216,870 | A | * | 8/1980 | Bonneson et al. ..... 212/223 |
| 4,271,970 | A | | 6/1981 | Miller et al. |
| 4,446,977 | A | * | 5/1984 | McClain ..... 212/247 |
| 4,576,518 | A | | 3/1986 | Cooke et al. |
| 4,589,801 | A | | 5/1986 | Salama |
| 5,014,863 | A | * | 5/1991 | Vlaanderen ..... 212/182 |
| 5,186,343 | A | * | 2/1993 | Bozzi ..... 212/206 |
| 5,310,067 | A | | 5/1994 | Morrow |
| 5,328,040 | A | | 7/1994 | Morrow |
| 5,487,478 | A | | 1/1996 | Morrow |

FOREIGN PATENT DOCUMENTS

| | | | |
|---|---|---|---|
| WO | 99/11518 | * | 3/1999 |

* cited by examiner

*Primary Examiner*—Thomas J. Brahan
(74) *Attorney, Agent, or Firm*—Keaty Professional Law Corporation

(57) ABSTRACT

An inverted pedestal crane has a base mountable to an underside of a horizontal support structure, such as for example a rig floor. A crane pedestal extends downwardly from the base, and a boom connects pivotally to the pedestal. The pedestal and the crane base rotate about a vertical axis, while the boom moves pivotally in relation to the pedestal. The crane has one main and a pair of auxiliary hydraulic rams for moving the boom during load handling operations. A robust slew bearing assembly mounted above the crane pedestal allows rotation of the base and the pedestal. The slew bearing assembly has a pair of parallel plates, a plurality of centering rollers and a plurality of stabilizing rollers mounted adjacent to an outer circumference of the parallel plates, between the plates. A winch assembly is mounted on top of the base, the winch assembly carrying a cable that extends over a pulley secured to a free end of the boom. A truss assembly secured to the pedestal and to an underside of the base resists overturning moments acting on the crane when the boom engages a load. An operator cab is mounted on a support plate adjacent a lower portion of the pedestal.

18 Claims, 3 Drawing Sheets

INVERTED PEDESTAL CRANE

BACKGROUND OF THE INVENTION

This invention relates to a pedestal crane and, more particularly to a crane designed for operations on offshore drilling and production platforms and other marine structures.

Conventionally, a number of exploration and completion operations are conducted with the use of independently air-powered and chain-operated hoists. These operations include blowout preventor handling, wellhead installation and maintenance, installation of topside components from jackup drilling units. Generally, two hoists are used in tandem; they perform a number of operations, for example raising and lowering of blowout preventors to and from the wellhead and transporting the blowout preventors to and from a storage location on the rig.

When the hoisting operations are conducted, other operations in the vicinity and on the drill floor are usually suspended, causing loss of productive rig time, creating a potential for hazardous conditions for the rig personnel, especially when heavy pieces of equipment are transported by overhead cranes.

Hoisting and handling of many components below the drill floor usually requires elaborate rigging with snatch blocks, slings and the like. Personnel on the rig floor and in the platform/cellar area usually communicate by radio or telephone, which adds to the complexity of performing a simple jacket topside operation.

In many cases, equipment delivered to an offshore platform is raised from the boat onto the deck with the deck cranes. The delivered equipment is then stored on deck, requiring additional maneuvering for installation in place. The double handling of the loads, particularly in jacket topside operations uses valuable rig time, increases the potential for damaging expensive equipment, creates potential hazard to the personnel and thus is not very efficient.

In view of the severe space restrictions, cranes for offshore facilities have to be compact. For example, U.S. Pat. No. 4,271,970 issued on Jun. 8, 1991 discloses a compact pedestal crane which is mounted on a drill rig floor. A dynamic load compensator absorbs sudden shock loads due to wave motions. However, despite the compactness of the design, this crane will still occupy valuable platform deck space.

U.S. Pat. No. 5,487,478 issued on Jan. 30, 1996 discloses a crane with an inverted kingpost. The crane has upper and lower bearings constructed of relatively soft bearing material that cooperates with relatively hard kingpost and upperworks structures. The design allows for access to conduct inspection or maintenance of components. Other U.S. patents, for example U.S. Pat. Nos. 3,898,847; 3,949,693; 4,576,518 and 4,589,801 all teach offshore oil rig structures with cranes.

The present invention contemplates elimination of drawbacks associated with the prior art and provision of a crane suitable for use on a jack-up drilling unit where it allows handling of loads from supply boats to the platform in an efficient manner, and other jacket topside load handling activities.

SUMMARY OF THE INVENTION

It is, therefore, an object of the present invention to provide a hoisting mechanism for an offshore jackup drilling unit.

It is another object of the present invention to provide an inverted pedestal crane that can be suspended from the underside of the rig floor to allow topside operations to be conducted contemporaneously with drill floor operations.

It is a further object of the present invention to provide an inverted pedestal crane that is hydraulically operated independently of a rig floor activity below the rig floor area.

These and other objects of the present invention are achieved through a provision of an inverted pedestal crane that has a base mountable to an underside of a horizontal support structure, such as for example a rig floor. A crane pedestal extends downwardly from the base, and a boom connects pivotally to the pedestal. The pedestal and the crane base rotate about a vertical axis, while the boom moves pivotally in relation to the pedestal. The crane has one main and a pair of auxiliary hydraulic rams for moving the boom during load handling operations.

The crane uses no counterweights. The overturning moments are efficiently handled by the supporting truss work that is secured to the pedestal and to an underside of the base, resisting overturning moments acting on the crane during load handling. The truss work, in turn, houses an hydraulically driven, rotating pinion drive mechanism, which is engaged to an oversize base. The base carries the inverted crane components. The oversize base and the truss work further enhance functionality of the crane by offsetting any radial point loadings and transmitting the moment to the slew bearing.

A pin and yoke of the main hydraulic ram cylinder are located in close proximity to the outside circumference of the base, thereby improving the operation of a robust slew bearing assembly that is mounted above the crane pedestal. The slew bearing assembly has a pair of parallel plates, a plurality of centering rollers and a plurality of stabilizing Hillman-type rollers mounted adjacent to an outer circumference of the parallel plates, between the plates.

A winch assembly is mounted on top of the base, the winch assembly carrying a cable that extends over a pulley secured to a free end of the boom. A truss assembly secured to the pedestal and to an underside of the base resists overturning moments acting on the crane when the boom engages a load. An operator cab is mounted on a support plate adjacent a lower portion of the pedestal.

The crane is adapted for operation under conditions where space is at a premium, such as for example an offshore platform. Of course, the crane can be used in other applications, its main advantage being its capability to be suspended from an underside of a horizontal surface, the top of which can be used for other operations and structures.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
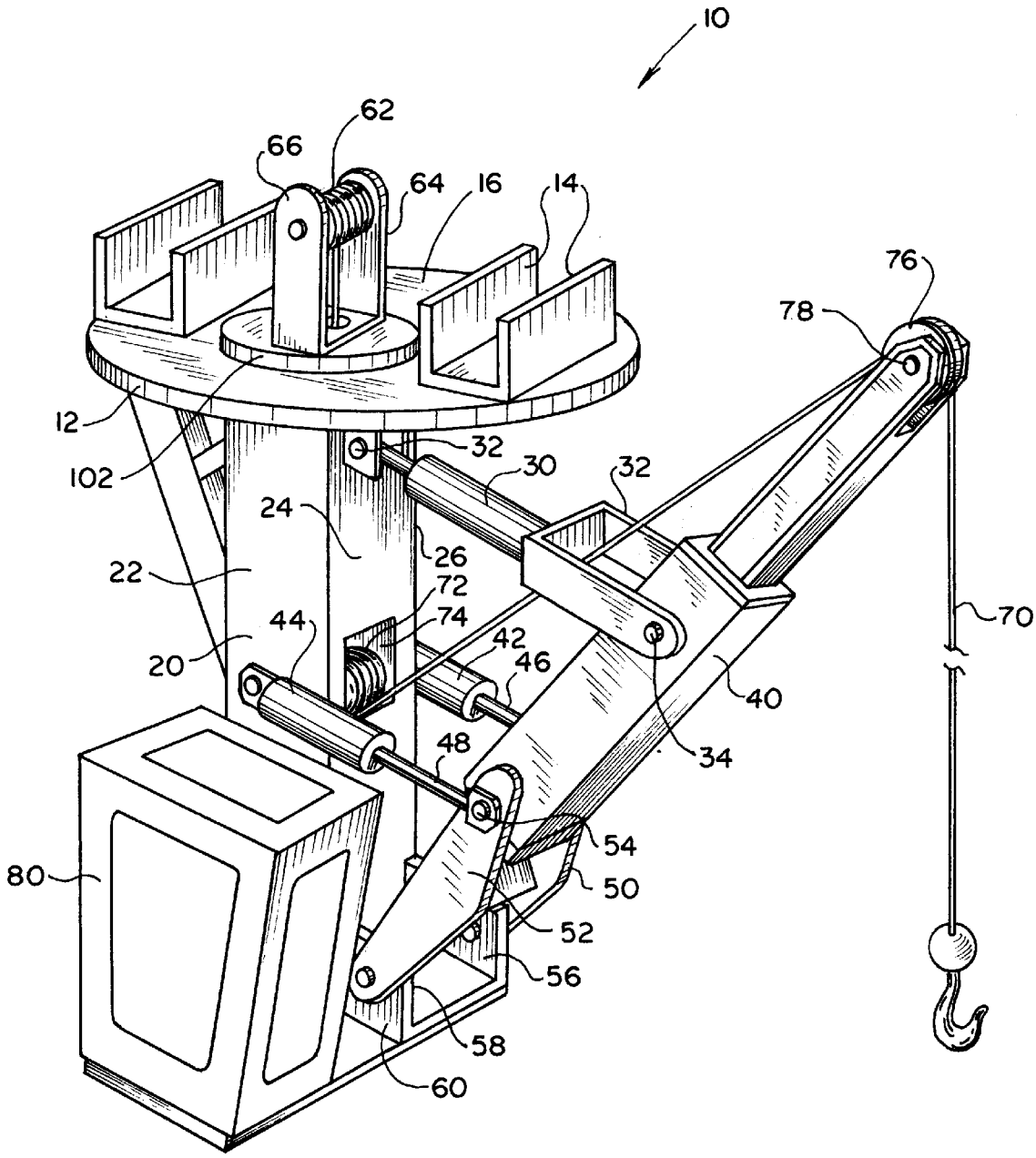
FIG. 1 is a perspective view of an inverted pedestal crane in accordance with the present invention.

Turning now to the drawings in more detail, numeral 10 designates the inverted pedestal crane in accordance with the present invention. The crane 10 comprises a rotational base 12 adapted to the secured, by means of rails 14, to an underside of a raised platform (not shown). The rails 14 are fixedly attached to a top surface 16 of the base 12 and extend upwardly therefrom.

A central mast 20 extends downwardly from the base 12, the mast, or pedestal 20, being defined by vertically extending walls 22, 24, and 26. A main hydraulic cylinder 30 extends outwardly from the wall 24 through an opening 32 formed in the wall 24 of the mast 20. The distant end of the main hydraulic cylinder carries a clevis 32 with two parallel arms that form a U-shaped shackle. The ends of the clevis 32 are drilled to receive pegs 34 for securing a boom 40 to the main hydraulic cylinder 30.

A pair of smaller auxiliary hydraulic cylinders 42 and 44 are pivotally connected to the vertical walls 22 and 26 of the mast 20. The distal ends of the auxiliary cylinders fit are secured, through piston rods 46 and 48 to their respective struts 50 and 52. The struts, through pin connection 54 are secured for pivotal movement to the boom 40 a distance from the pivotal connection 34.

Opposite ends of the struts 50 and 52 are pivotally attached to vertically extending bottom rails 56 and 58 that extend forwardly from the mast 20 and are fixedly attached to a pedestal 60. The hydraulic cylinders 30, 42 and 44 are connected to a hydraulic power source located in the mast 20 by conventional means (not shown). The hydraulic power source acts on the piston rods of the hydraulic cylinders 30, 42 and 44 to raise and lower the boom 40 during crane operations.

The crane 10 comprises a cable system including a winch 62 supported by end plates 64 and 66 above the base 12. The winch 62 carries a load of cables 70 that passes through the mast 20 to a first pulley 72 located inside the mast 20. An opening 74 allows the cable 70 to be extended over a boom pulley 76 mounted on a shaft 78 adjacent the most distal end of the boom 40. The outermost end of the cable 70 carries a hook that allows lifting and lowering of the loads by the crane 10.

Figure 2:
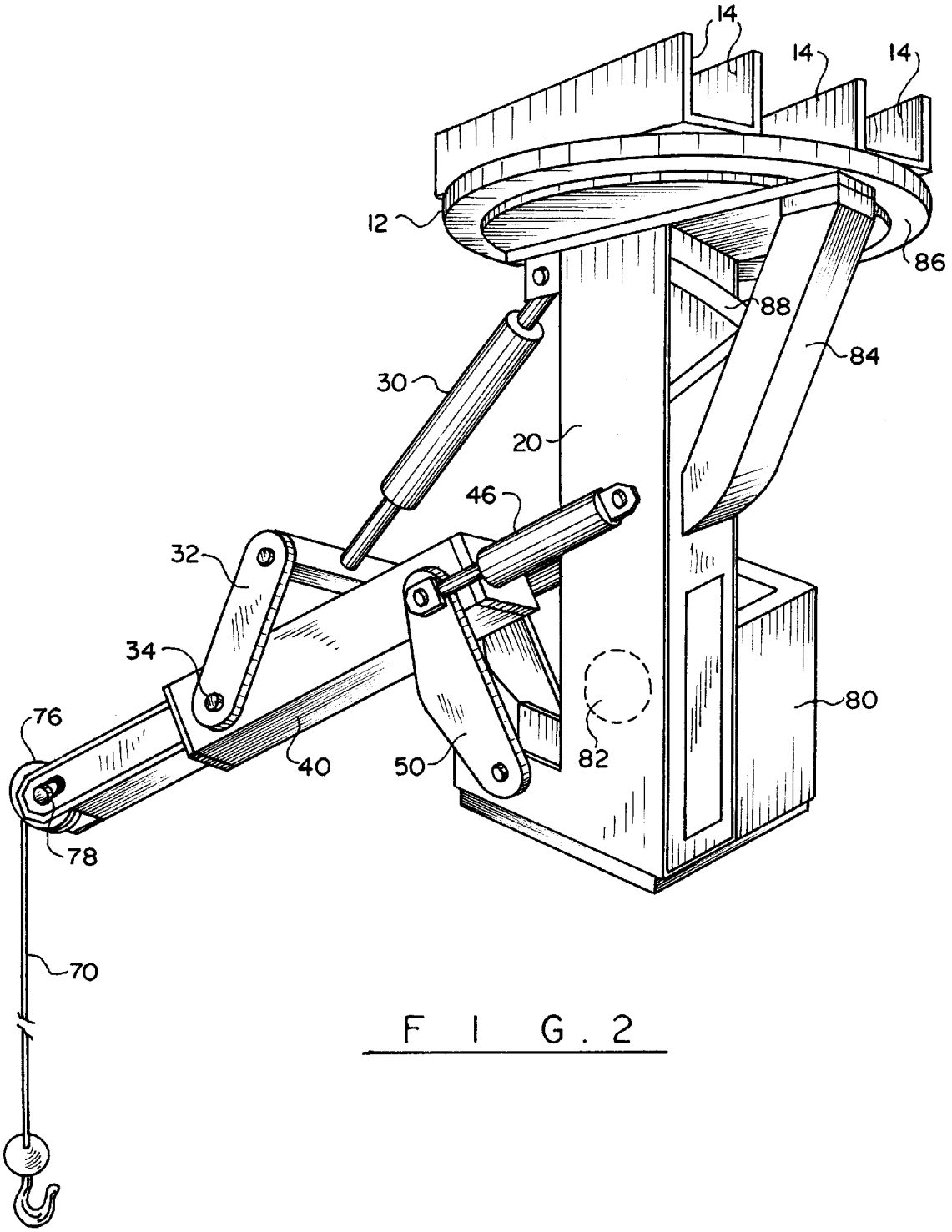
FIG. 2 is a perspective view of the crane of the present invention showing an alternative position of a winch.

A cab 80 is mounted onto a platform 60 adjacent the mast 20. The cab 80 houses controls for operation of the hydraulic cylinders, winch, for the crane rotation and the like. An operator, sitting in the cab 80 operates the crane in a conventional manner. An auxiliary winch 82 (FIG. 2) can be positioned inside the mast below the hydraulic cylinders 42 and 44. A supporting boom 84 extends from the mast 20 to underneath the bottom surface 86 of the base 12. Suitable braces 88 can be provided for increase stability of the mast in relation to the rotational base 12.

The base 12 houses a hydraulically driven, rotating pinion drive mechanism which is engaged to the base 12 which supports an inverted drive rack, as will be described below. The loads acting on the crane base and the overturning moment are counteracted by means of supporting transverse of beam 84 and braces 88. The circular base 12 is intentionally oversized to help reduce overturning moment and bending moment on the mast 20 when the crane 40 engages a load. This feature becomes particularly important when the crane 40 telescopically extends outwardly from the platform to lift up the load from a nearby boat or barge.

Figure 4:
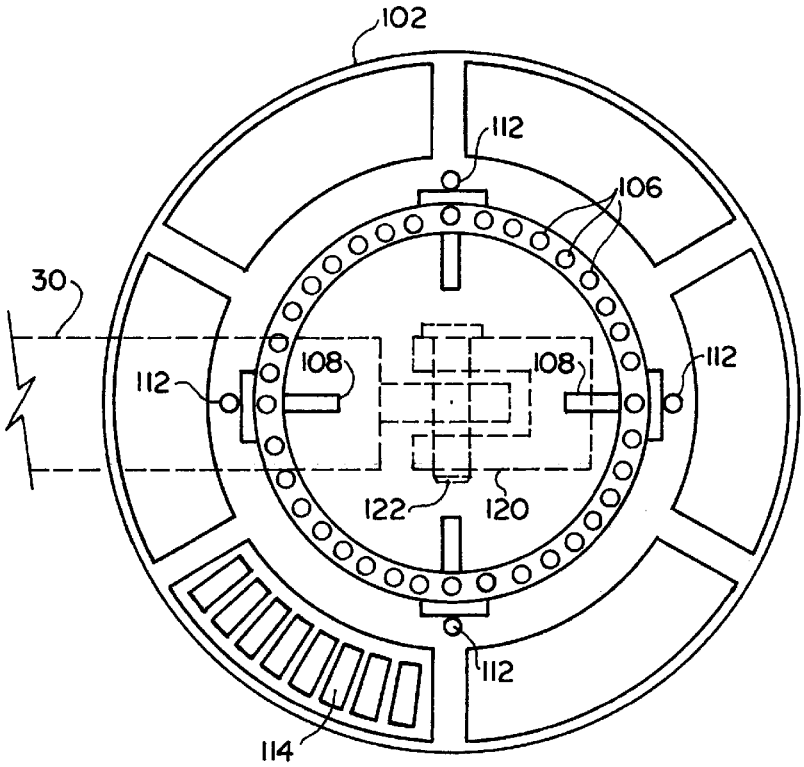
FIG. 4 is a detailed view showing a slew bearing assembly.
Figure 3:
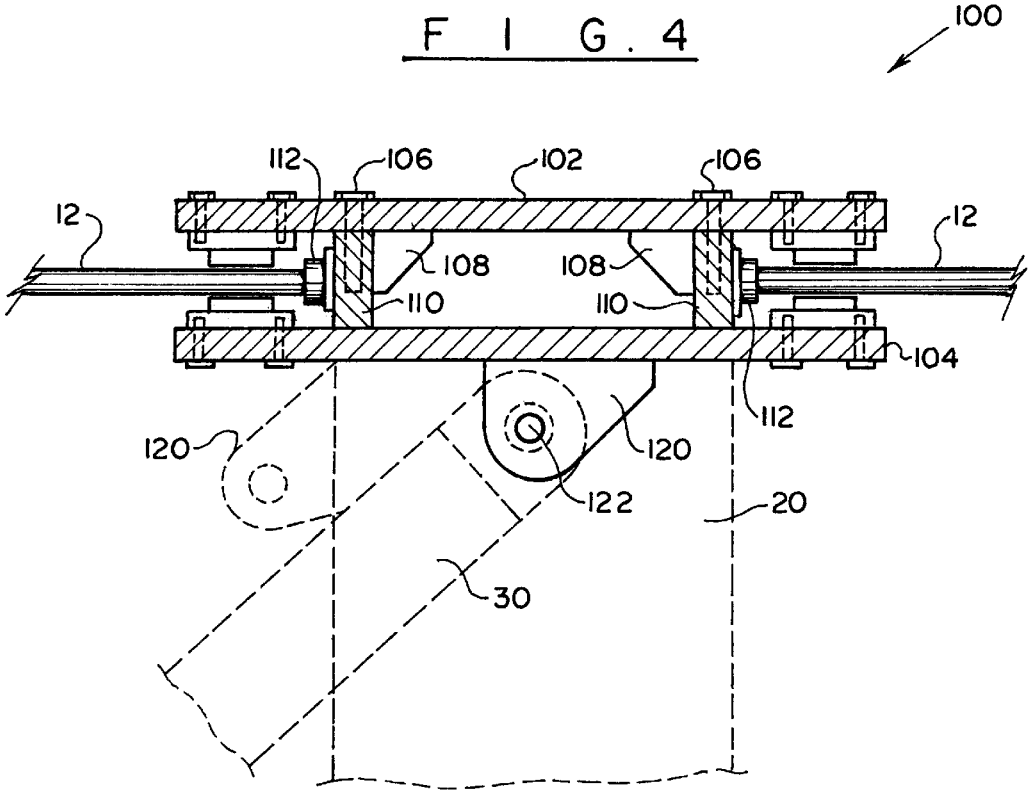
FIG. 3 is a detailed, partially cross-sectional view showing position of slew bearings for supporting the cranes.

Turning now to FIGS. 3 and 4, the details of a slew bearing assembly are illustrated. The robust slew bearing is designed to facilitate rotation of the base 12 and of the entire crane assembly during lifting operations.

The slew bearing assembly 100 comprises two parallel flanges, or plates 102 and 104 bolted together by bolts 106. A plurality of chocks 108 help retain the bolted flanges 102 and 104 in a spaced-apart relationship. The chocks 108 are attached to space bars 110 secured between the flanges 102 and 104. A plurality of pedestal centralizing rollers 112 (FIG. 4) are fitted between the flanges 102 and 104.

Another set of rollers, stablizing Hillman-type rollers 114, are fitted closer to the outer circumference of the flanges 102 and 104. The Hillman-type rollers 114 and the pedestal centralizing rollers 112 facilitate smoother rotational movement of the crane about a vertical axis and resist bending moments acting on the mast when the boom 40 is extended for handling the loads.

As shown in the drawings, the main cylinder 30 is connected in a substantially co-axial alignment with the center of the slew bearing assembly. A yoke 120 is secured by a pin 122 to the main cylinder 30. Shown in FIG. 3 in phantom lines is an alternate location of the yoke 120. This position of the yoke clevis allows attachment of the main cylinder closer to the outer circumference of the slew bearing assembly. It is believed that the alternative attachment of the yoke and pin assembly further facilities smooth rotational movement of the boom 40 and allows an alternative positioning of the auxiliary winch at the base of the pedestal.

As can be seen in the drawings, the crane uses no counterweights. The overturning moments are efficiently handled by the supporting truss work. The truss work, in turn, houses an hydraulically driven, rotating pinion drive mechanism, which is engaged to an oversize base. The base carries the inverted crane components. The oversize base and the truss work further enhance functionality of the crane by offsetting any radial point loadings and transmitting the moment to the slew bearing. By locating the pin and yoke of the main hydraulic ram cylinder in close proximity to the outside circumference of the base, the operation of the robust slew bearing is substantially improved.

It is envisioned that the crane main lift capacity would be in the order of 120 tons. This capacity can be achieved because of the provision of two smaller, auxiliary rams that assist the main hydraulic ram in the load handling operations. The cab located under the rig floor, between the rig's cantilever beams, allows safe telescopic boom extension for raising and lowering of the loads to and from a supply boat aft of the cantilever.

It is further envisioned that the crane of the present invention would have a 10-ton whip line capacity for auxiliary equipment handling on or around the platform topsides, under the rig floor. At the same time, the crane does not occupy the valuable deck space and allows conducting of the load handling operations independently of the main rig floor activity, thus saving operations costs.

Many changes and modifications can be made in the design of the present invention without departing from the spirit thereof. I, therefore, pray that my rights to the present invention be limited only by the scope of the appended claims.

I claim:

1. A pedestal crane, comprising:

a base;

a means secured to a top surface of said base for securing said base to an underside of a horizontal support structure;

a pedestal extending downwardly from said base said pedestal has a lower unsecured portion;

a boom pivotally connected to said pedestal; and a means coupled to said pedestal for rotating said pedestal about a vertical axis, said rotating means comprising a slew bearing assembly mounted above said pedestal, said slew bearing assembly comprising a pair of parallel plates retained in a spaced-apart relationship to each other, a plurality of centering rollers for centering position of said pedestal in relation to said base and a plurality of stabilizing rollers mounted between said plates adjacent outer edges of said plates.

2. The crane of claim 1, further comprising a means coupled to said pedestal for rotating said base about a vertical axis.

3. The crane of claim 2, further comprising a means coupled to said pedestal and said boom for pivotally moving said boom in relation to said pedestal.

4. The crane of claim 3, wherein said means for pivotally moving the boom comprises at least one extendable arm secured to an upper portion of said pedestal and to said boom.

5. The crane of claim 4, further comprising a pair auxiliary arms secured to the pedestal a distance below said at least one arm and to a lower portion of said boom.

6. The crane of claim 4, wherein said at least one arm comprises a hydraulic cylinder with a telescopically extendable piston, said piston carrying a yoke for securing said at least one arm to said boom.

7. The crane of claim 5, wherein each of said auxiliary arms comprises a hydraulic cylinder with extendable piston pivotally secured to said boom.

8. The crane of claim 4, wherein said at least one arm is pivotally connected to said pedestal by a yoke and a pin passing through said yoke.

9. The crane of claim 8, wherein said slew bearing assembly has a central axis, and wherein said pin is mounted co-axially with the central axis of said slew bearing assembly.

10. The crane of claim 1, further comprising a winch assembly mounted on top of said base, said winch assembly carrying a cable that extends over a pulley secured to a free end of said boom.

11. The crane of claim 1, further comprising a truss assembly secured to said pedestal and to an underside of said base, said truss assembly resisting overturning moments acting on sad crane when said boom engages a load.

12. The crane of claim 1, further comprising an operator cab mounted on a support plate adjacent a lower portion of said pedestal.

13. An inverted pedestal crane for use in load handling operations, comprising:

a circular base;

a means secured to a top surface of said base for supporting the base from an underside of a horizontal support structure;

a pedestal extending downwardly from said base, said base and said pedestal rotating about a vertical axis, said base having a diameter substantially greater than a peripheral outer surface of said pedestal, said pedestal having an unsupported lower portion;

a boom pivotally connected to said pedestal; a rotating assembly mounted above said pedestal for rotating said pedestal about a vertical axis, said rotating assembly comprising a pair of parallel plates retained in a spaced-apart relationship to each other, a plurality of centering roller located adjacent a center of each of said plates for centering position of said pedestal in relation to said base and a plurality of stabilizing rollers mounted a distance from said centering rollers adjacent to outer edge of said plates;

a means coupled to said pedestal and said boom for pivotally moving said boom in relation to said pedestal; and a truss assembly secured to said pedestal and to an underside of said base, said truss assembly resisting overturning moments acting in said crane when said boom engages a load.

14. The crane of claim 13, further comprising a winch assembly mounted an top of said base, said winch assembly carrying a cable that extends over a pulley secured to a free end of said boom.

15. The crane of claim 13, further comprising an operator cab mounted on a support plate adjacent a lower portion of said pedestal.

16. The crane of claim 13, wherein said means for pivotally moving the boom comprises a main hydraulic ram secured to an upper portion of said pedestal and to said boom and a pair of auxiliary hydraulic rams secured to the pedestal a distance below said main hydraulic ram and to portion of said boom.

17. The crane of claim 16, wherein said main hydraulic ram is provided with a telescopically extendable piston, said piston cog a yoke for securing said main hydraulic ram to said boom.

18. The crane of claim 17, wherein each of said auxiliary hydraulic rams comprises an extendable piston pivotally secured to said boom.

* * * * *